US006791270B2

(12) United States Patent
Kim et al.

(10) Patent No.: US 6,791,270 B2
(45) Date of Patent: Sep. 14, 2004

(54) LIGHT APPARATUS USING MICROWAVE HAVING A WAVEGUIDE WITHIN AN INTERNAL DOMAIN OF A RESONATOR

(75) Inventors: Hyun Jung Kim, Seoul (KR); Hyo Sik Jeon, Gwangmyeong (KR)

(73) Assignee: LG Electronics Inc., Seoul (KR)

( * ) Notice: Subject to any disclaimer, the term of this patent is extended or adjusted under 35 U.S.C. 154(b) by 38 days.

(21) Appl. No.: 09/986,398

(22) Filed: Nov. 8, 2001

(65) Prior Publication Data

US 2002/0089287 A1 Jul. 11, 2002

(30) Foreign Application Priority Data

Jan. 8, 2001 (KR) ..... 10-2001-0000970

(51) Int. Cl.[7] ..... H01J 65/04
(52) U.S. Cl. ..... 315/39; 315/248
(58) Field of Search ..... 315/39, 248

(56) References Cited

U.S. PATENT DOCUMENTS 5,227,698 A * 7/1993 Simpson et al. ..... 315/248
5,525,865 A * 6/1996 Simpson ..... 315/30

* cited by examiner

*Primary Examiner*—Benny T. Lee
(74) *Attorney, Agent, or Firm*—Birch, Stewart, Kolasch & Birch, LLP

(57) ABSTRACT

In a lighting apparatus using microwave, a lighting apparatus using microwave including a resonator excluding microwave and transmitting a fight, a waveguide placed at an internal domain of the resonator and transmitting the microwave, a microwave generating means installed at the side of the resonator and oscillating microwave into the waveguide, and a bulb placed at the center of the resonator and emitting light by generating a plasma by the microwave transmitted through the waveguide is capable of miniaturizing a lighting system and at the same time improving a lighting efficiency.

19 Claims, 4 Drawing Sheets

LIGHT APPARATUS USING MICROWAVE HAVING A WAVEGUIDE WITHIN AN INTERNAL DOMAIN OF A RESONATOR

BACKGROUND OF THE INVENTION

1. Field of the Invention

The present invention relates to a lighting apparatus using microwaves and in particular to a lighting apparatus using microwaves which is capable of emitting lights by applying microwaves an electrodeless bulb.

2. Description of the Conventional Art

A lighting apparatus using microwaves emits visible rays or ultraviolet rays by applying microwaves to an electrodeless bulb, it has longer life span and better lighting effectiveness than a general incandescent lamp or a fluorescent lamp.

FIG. 1 is a longitudinal sectional view illustrating an internal structure of a lighting apparatus using microwaves.

A lighting apparatus using microwaves includes a magnetron 1, a waveguide 3 transmitting microwaves from the magnetron 1 to a bulb 5, the bulb 5 emitting light from the plasma generated from the enclosed materials which are excited by the microwave energy transmitted through the waveguide 3, and a resonator 10 placed in front of the waveguide 3 and the bulb 5, excluding the microwaves and transmitting the light emitted from the bulb 5.

Particularly, the resonator 10 has a cylindrical shape and has a metal mesh structure in order to exclude microwaves while transmitting the light emitted from the bulb 5.

The lighting apparatus using microwaves further includes a high voltage generator 7 for boosting the voltage of an alternating current and supplying it to the magnetron 1, a cooling unit 9 for refrigerating the magnetron 1 and the high voltage generator 7, a reflector 11 intensively reflecting the light emitted from the bulb 5, and a control unit (not shown) controlling various elements including the high voltage generator 7 and the cooling unit 9.

In the lighting apparatus using microwaves, when an operating signal is inputted from the control unit to the high voltage generator 7, the high voltage generator 7 boost the voltage of the AC power and supplies the boosted AC power to the magnetron 1.

The magnetron 1 oscillates due to the high voltage supplied from the high voltage generator 7 and generates microwaves having a very high frequency, the generated microwaves are emitted into the resonator 10 through the waveguide 3, materials enclosed inside the bulb 5 are discharged, accordingly light having an inherent emission spectrum is generated.

The light generated from the bulb 5 is reflected by a mirror 12 and the reflector 11 and lights up a space.

However, in the lighting apparatus using microwaves in accordance with the background art, because the resonator 10 is constructed with a cylindrical metal mesh, most of the light emitted from the bulb 5 transmits through the metal mesh, and part of the light is reflected on the metal mesh and scattered all over the place inside the resonator 10, accordingly there is a limitation in maximizing a lighting efficiency.

In more detail, because the resonator 10 has the cylindrical shape, a focus of the light reflected onto the metal mesh is not fixed and the light is reflected intricately and scattered all over the place, accordingly the lighting efficiency is lowered due to the loss of the light.

In addition, because the resonator 10 projects lengthwise from the front of the waveguide 3, and a large size reflector 11 is required to surround the resonator 10, it is difficult to minimize the size of the lighting system.

SUMMARY OF THE INVENTION

In order to solve the above-mentioned problems, it is an object of the present invention to provide a lighting apparatus using microwaves which is capable of improving a lighting efficiency and miniaturizing a lighting system by minimizing a loss of light emitted from a bulb by installing a waveguide inside a resonator and installing a bulb at the center of the resonator.

In order to achieve the object of the present invention, a lighting apparatus using microwaves includes a resonator transmitting a light but preventing the escape of microwaves, a waveguide placed at an internal domain of the resonator and transmuting the microwaves, a microwave generating means installed at the side of the resonator and transmitting microwaves into the waveguide, and a bulb placed at the center of the resonator and emitting light resulting from a plasma which is excited by the microwaves transmitted through the waveguide.

Herein, the resonator has a spherical shape, and the waveguide is installed within a radial sector of the resonator.

The waveguide has a conical shape, the vertex of the waveguide is placed at the center of the resonator, the cover portion of the waveguide is formed as a curved surface having a shape the same as the spherical shape of the resonator and Is placed so as to correspond to an external extended portion of the resonator.

The lighting apparatus using microwaves having the microwave generating means further includes a high voltage generator and a casing covering a cooling unit, and the casing is combined and fixed to the cover portion of the waveguide at the external extended portion of the resonator.

The bulb is placed at the center of the resonator, and the microwave generating means is fixed to the waveguide at the external extended portion of the resonator.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Hereinafter, a lighting apparatus using microwaves in accordance with the present invention will be described with reference to the accompanying drawings.

There can be a plurality of embodiments of a lighting apparatus using microwaves in accordance with the present invention, hereinafter the most preferable embodiment will be described.

Figure 1:
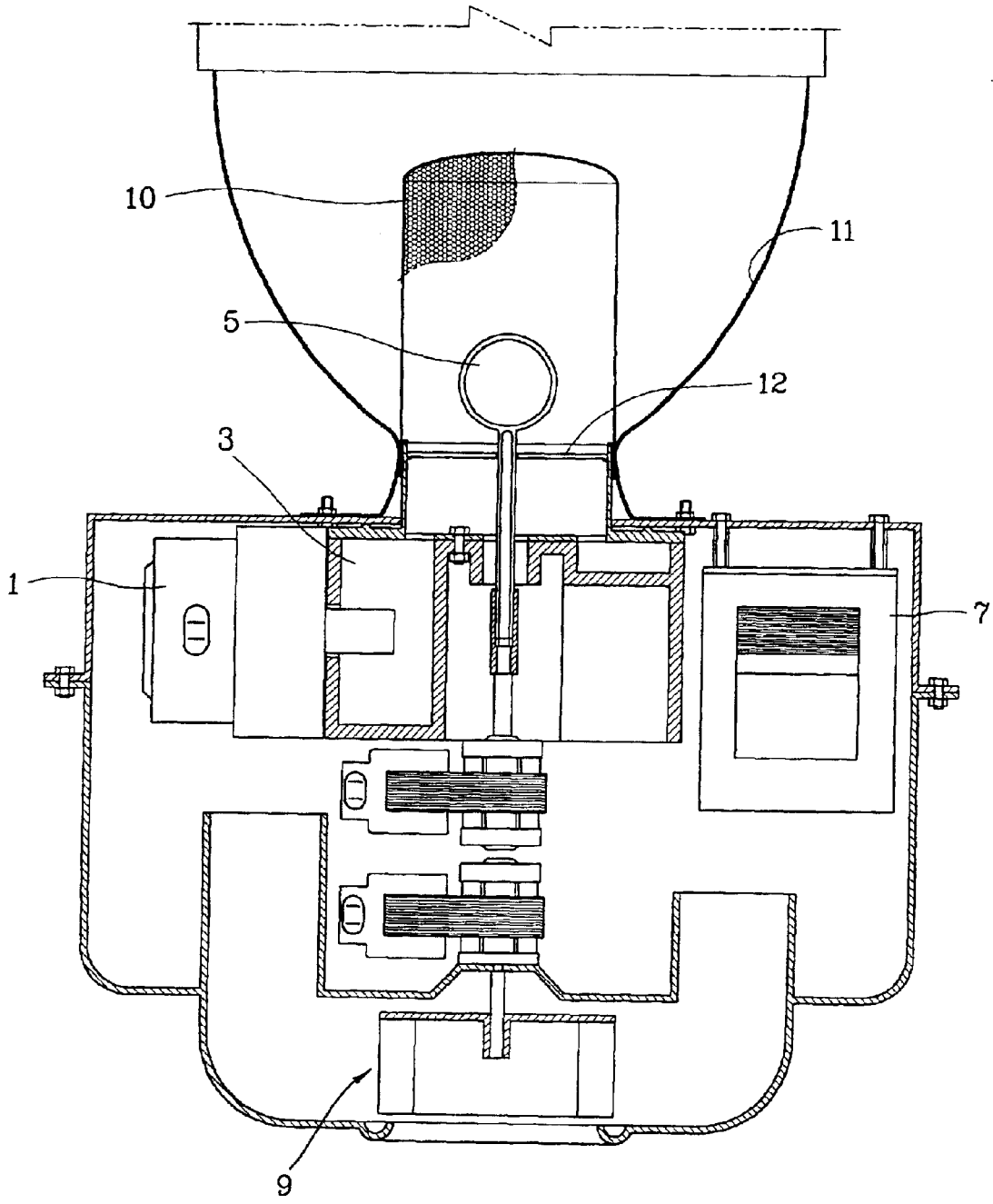
FIG. 1 BACKGROUND ART
FIG. 1 is a longitudinal sectional view illustrating a lighting apparatus using microwaves in accordance with the background art.
Figure 2:
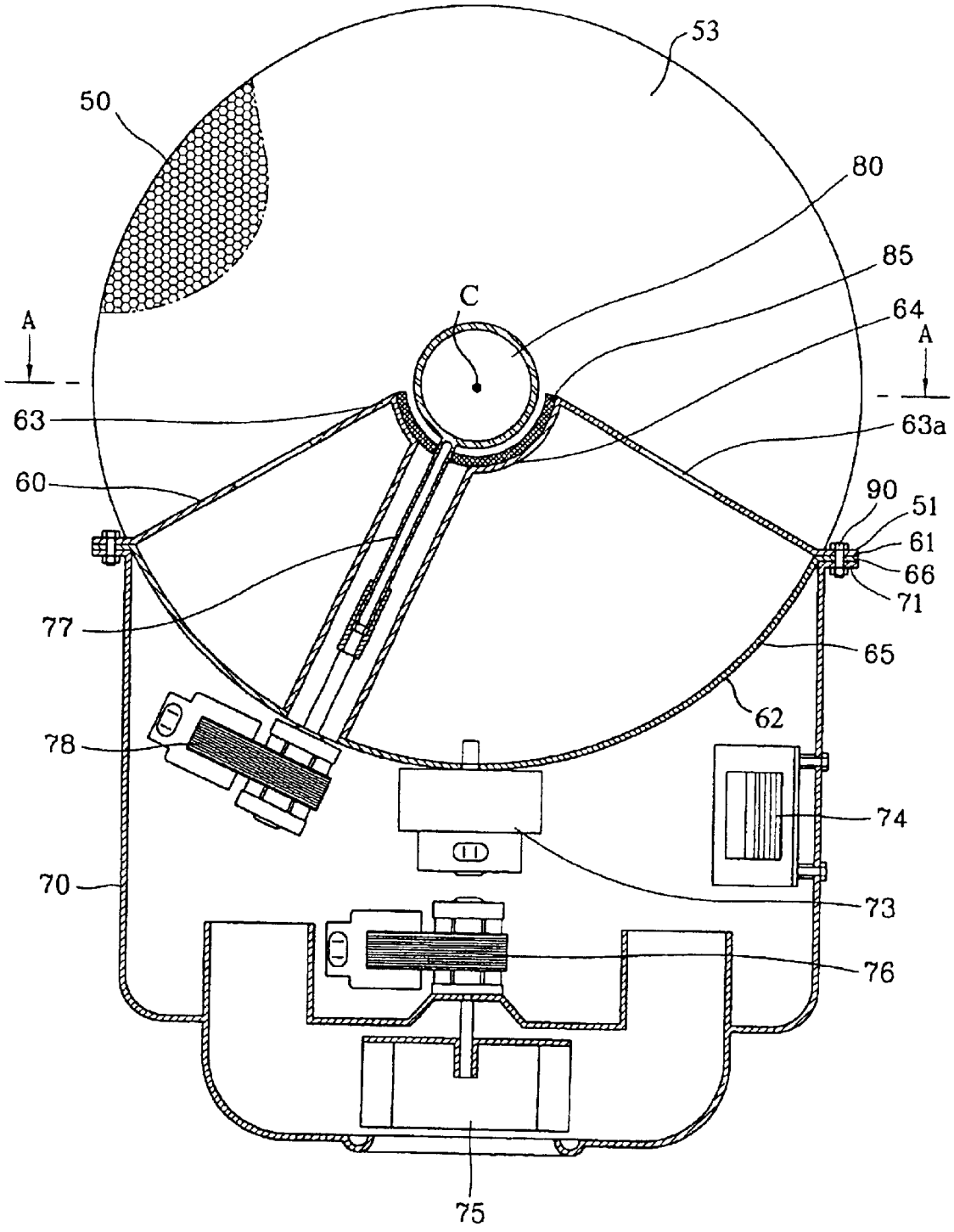
FIG. 2 is a longitudinal sectional view illustrating a lighting apparatus using microwaves in accordance with the present invention.
Figure 3:
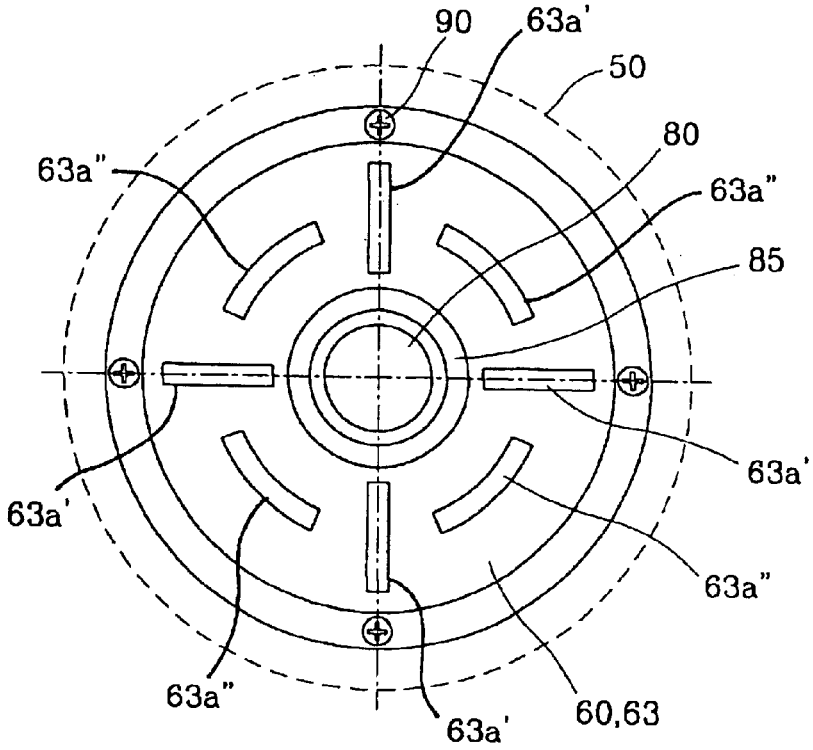
FIG. 3 is a plan view illustrating the lighting apparatus of FIG. 2 taken along the line of A—A.

FIG. 2 is a longitudinal sectional view illustrating a lighting apparatus using microwaves in accordance with the present invention, and FIG. 3 is a plan view illustrating the lighting apparatus of FIG. 2 taken along the line of A—A.

As shown in FIG. 2, lighting apparatus using microwaves in accordance with the present invention includes a resonator 50 having a metal mesh structure and an opened lower portion, a waveguide 60 inserted into the opened portion of the resonator 50, placed at the internal area 53 of the resonator 50 having a spherical structure and transmitting microwaves, and a casing 70 combined to the bottom portion 62 of the resonator 50 (see also FIG. 3) and the waveguide 60.

A plurality of outwardly extended flange portions 51, 61, 66, 71 are respectively formed at the resonator 50, waveguide 60 and casing 70 and adhered tightly by bolts 90 as shown in FIGS. 2 and 3.

The resonator 50 has a metal mesh structure constructed with a certain size of hole except at the flange portion 51 so as to exclude microwaves and transmit light, and the bulb 80 (also see FIG. 3), emitting light resulting from a plasma which is excited by the microwaves transmitted through the waveguide 60, is placed at the center of the sphere shaped resonator 50.

The waveguide 60 has a conical shape having an opened bottom portion 62 and is constructed with a body portion 63 placed inside the resonator 50 and a cover portion 65 formed as a curved surface same as the spherical shape of be resonator 50 and combined to the bottom portion 62 of the body portion 63.

At least one outlet 63*a* is formed at the inclined plane of the body portion 63 in order to transmit the microwaves transmitted from the magnetron 73 into an internal area 53 of resonator 50.

Particularly, a hollow concave portion 84 of a hemisphere shape is formed in order to make a place for the bulb 80 at the vertex of the waveguide 60.

A reflecting mirror 85 is installed between the bulb 80 and the concave portion 64 in order to reflect light emitted from the bulb 80.

Herein, a reflecting layer coated with materials having reflecting elements can be formed at the external surface of the concave portion 64 of the waveguide 60.

A rotation shaft 77 penetrating the waveguide 60 is connected to the bulb 80, and a bulb motor 78 rotating the bulb 80 is connected to the end portion of the rotation shaft 77 is installed at the bottom surface of the waveguide 60.

The magnetron 73 is installed at the bottom surface 65 of the waveguide 60 inside the casing 70 and oscillates microwaves inside the waveguide 60.

A high voltage generator 74 boosting AC current and supplying the boosted AC current to the magnetron 73 is installed at the internal side of the casing 70, and a refrigerating fan 75 and a motor for the refrigerating fan 76 are installed at the lower portion of the casing 70 in order to refrigerate the magnetron 73 and the high voltage generator 74.

As depicted in FIG. 3, four slots 63*a*' (first slots) with lengths formed in the radius direction and four slots 63*a*" (second slots) with lengths formed in the circumferential direction are arranged with a certain distance which is the same as in FIG. 2. Other elements shown in FIG. 3 include resonators 50, waveguide 60, body portion 63, reflecting mirror 85, and bolts 90.

Figure 4A:
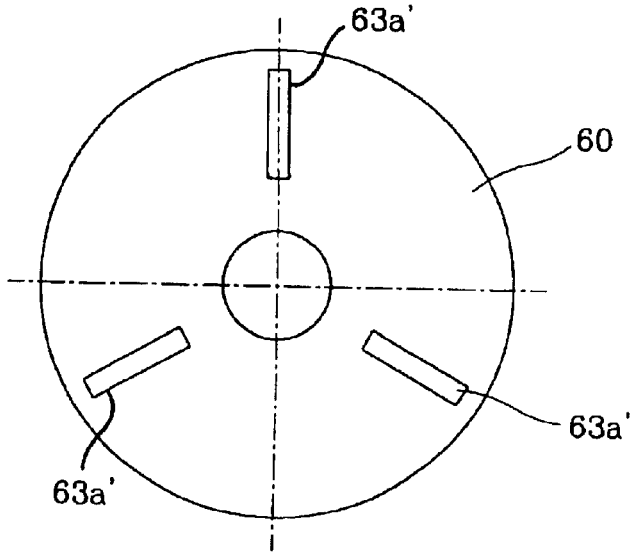
FIGS. 4A, 4B, and 4C are plan views of other embodiments illustrating shapes of waveguide in accordance with the present invention.
Figure 4B:
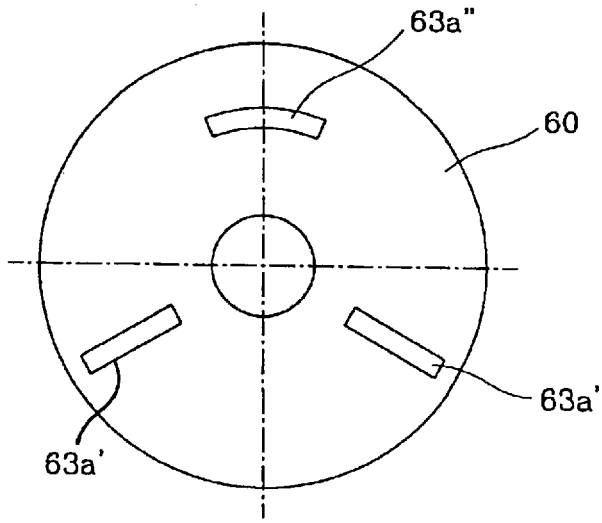
Figure 4C:
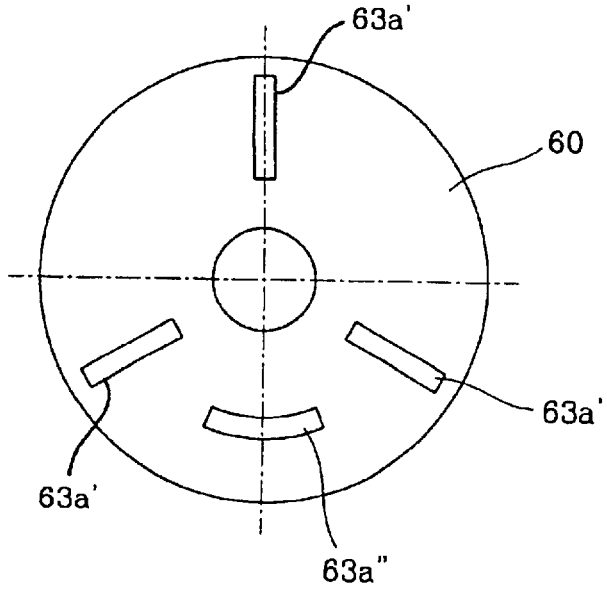

FIGS. 4A, 4B and 4C are plan views of other embodiments illustrating shapes of waveguide in accordance with the present invention.

As depicted in FIG. 4A, in another embodiment of the present invention, three slots 63*a*' with lengths formed in the radius direction are spaced apart by 120° at the outlet of the waveguide 60.

As depicted in FIG. 4B, in still another embodiment of the present invention, two slots 63*a*' with lengths formed in the radius direction and one slot 63*a*" with a length formed in the circumference direction are spaced apart by 120° at the outlet of the waveguide 60.

As depicted in FIG. 4C, in yet still another embodiment of the present invention, three slots 63*a*' with lengths formed in the radius direction and one slot 63*a*" with a length formed in the circumference direction are spaced apart by 120° at the outlet of the waveguide 60.

The operation of the lighting apparatus using microwaves in accordance with the present invention will be described.

When the magnetron 73 oscillates microwaves, the microwaves are transmitted into the waveguide 60 and are radiated inside the resonator through each outlet.

Herein, the microwaves emitted inside the resonator 50 perform a resonance motion inside the resonator 50, and generate a plasma and an inherent spectrum by exciting the materials enclosed inside the bulb 80

Most of light generated in the bulb 80 and reflected onto the reflecting mirror 85 is emitted in the front through the hole of the resonator 50, part of the light reflected onto the metal mesh of the resonator 50 is concentrated on the center C of the resonator 50 as shown in FIG. 2, namely the bulb 80 placed at the focus of the sphere, and is reflected in the front through the reflecting mirror 85, accordingly loss of the light can be reduced.

The lighting apparatus using microwaves in accordance with the present invention is capable of improving a lighting efficiency and miniaturizing a lighting system by minimizing loss of light emitted from a bulb by placing the bulb at the center of a resonator having a spherical shape and installing a waveguide inside the resonator.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lighting apparatus using microwaves, comprising:

a resonator for transmitting a light and preventing an escape of the microwaves;

a conical shaped waveguide for transmitting the microwaves into the resonator;

a microwave generating means installed on a side of the waveguide and transmitting the microwaves into the waveguide; and a bulb placed at a center of the resonator and emitting the light resulting from a plasma excited by the microwaves transmitted through the waveguide, wherein said waveguide is placed at an internal domain of the resonator.

2. The apparatus of claim 1 wherein the resonator has a spherical shape, and the waveguide is installed within a radial sector of the resonator.

3. The apparatus of claim 2, wherein the resonator has an opened portion for receiving the waveguide, and the waveguide is fixed to the resonator by being inserted into the opened portion of the resonator.

4. The apparatus of claim 3, wherein outwardly extended flange portions are respectively provided on the resonator and the waveguide, and respectively fixed to the resonator and the waveguide by fixing means.

5. The apparatus of claim 2, wherein a vertex of the conical shaped waveguide is placed at the center of the resonator, an opened bottom portion of the waveguide is provided with a curved surface having a same shape as the spherical shape of the resonator , the bottom portion of the waveguide corresponding to an external extended portion of the resonator.

6. The apparatus of claim 5, wherein the waveguide includes a conical shaped body portion, and a cover portion being fixed to the opened bottom portion.

7. The apparatus of claim 5, wherein the waveguide has at least one first outlet at an inclined plane to an internal area of the resonator in order to transmit microwaves into the resonator.

8. The apparatus of claim 7, wherein a plurality of first outlets are provided with lengths in a radial direction of the resonator and centering around the vertex of the waveguide.

9. The apparatus of claim 7, wherein the at least one first outlet is arranged with a length in a radial direction of the resonator and at least one second outlet is arranged with a length in a circumferential direction of the resonator, the first and second outlets being centered around the vertex of the waveguide .

10. The apparatus of claim 5, wherein the vertex of the waveguide includes a concave portion for receiving the bulb.

11. The apparatus of claim 10, wherein a reflecting means is installed between the bulb and the concave potion of the waveguide in order to reflect the light emitted from the bulb.

12. The apparatus of claim 11, wherein the reflecting means is a reflecting mirror installed between the bulb and the concave portion of the waveguide.

13. The apparatus of claim 11, wherein the reflecting means is a reflecting layer coated onto an outer surface of the concave portion of the waveguide.

14. The apparatus of claim 1, further comprising:

a casing combined and fixed to a bottom portion of the waveguide at the external region of an extended portion of the resonator in order to cover the microwave generating means, a high voltage generator and a cooling unit.

15. The apparatus of claim 1, further comprising a rotation shaft connected to the bulb and penetrating the waveguide; and a bulb motor placed at a bottom surface of the waveguide and rotating the bulb by being connected to the end of the rotation shaft.

16. The apparatus of claim 1, wherein the microwave generating means is fixed to the waveguide at external region of an extended portion of the resonator.

17. A lighting apparatus using microwaves, comprising:

a resonator for transmitting a light and preventing an escape of the microwaves;

a waveguide for transmitting the microwaves into the resonator;

a microwave generating means installed on a side of the waveguide and transmitting the microwaves into the waveguide;

a bulb placed at a center of the resonator and emitting the light resulting from a plasma excited by the microwaves transmitted through the waveguide; and outwardly extended flange portions respectively provided on the resonator and the waveguide, the waveguide being placed in an internal domain of the resonator and being fixed to the resonator by fixing means passing through the extended flange portions.

18. The apparatus of claim 17, wherein the waveguide is installed within a radial sector of the resonator.

19. The apparatus of claim 18, wherein the resonator has an opened portion for receiving the waveguide, and the waveguide is fixed to the resonator by being inserted into the open portion of the resonator.

* * * * *